US006787509B2

(12) United States Patent
Chambard et al.

(10) Patent No.: US 6,787,509 B2
(45) Date of Patent: Sep. 7, 2004

(54) GAS ENGINE LUBRICATING OIL COMPOSITION

(75) Inventors: Laurent Chambard, Faringdon (GB); Yolanda Owen, Charlton Wantage (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/238,002

(22) Filed: Sep. 9, 2002

(65) Prior Publication Data

US 2003/0069145 A1 Apr. 10, 2003

(30) Foreign Application Priority Data

Sep. 28, 2001 (EP) ..... 01308365

(51) Int. Cl.[7] ..... C10M 159/20
(52) U.S. Cl. ..... 508/460
(58) Field of Search ..... 508/460

(56) References Cited

U.S. PATENT DOCUMENTS 5,380,508 A 1/1995 Inoue ..... 423/286
5,726,133 A * 3/1998 Blahey et al. ..... 508/390
5,739,088 A 4/1998 Inoue et al. ..... 508/156
6,140,281 A 10/2000 Blahey et al. ..... 508/398
6,191,081 B1 * 2/2001 Cartwright et al. ..... 508/460
6,528,463 B1 * 3/2003 Gatto et al. ..... 508/367
6,596,672 B1 * 7/2003 Carrick et al. ..... 508/192
6,613,724 B2 * 9/2003 Strickland et al. ..... 508/460

FOREIGN PATENT DOCUMENTS

EP 0 354 621 A1 2/1990 ..... C07C/309/31
EP 0 486 893 A1 5/1992 ..... C07G/17/00
EP 0 779 355 A2 6/1997 ..... C10M/129/44
WO WO99/35218 7/1999 ..... C10M/163/00

* cited by examiner

*Primary Examiner*—Ellen M. McAvoy

(57) ABSTRACT

A gas engine lubricating oil composition that is substantially free from dispersant. The gas engine lubricating oil composition has a TBN in the range of 3.5 to 20. The gas engine lubricating oil composition comprises an oil of lubricating viscosity and at least one metal detergent.

12 Claims, No Drawings

GAS ENGINE LUBRICATING OIL COMPOSITION

This invention concerns a gas engine lubricating oil composition.

Gas engines, which are also called gas-fuelled or gas-fired engines, are used to drive pumping stations of natural-gas pipelines, blowers and generators in, for example, purification plants and on gas tankers. Gas engines may be two- or four-stroke, spark-ignited or compression-ignited. Gas Otto engines ignite a mixture of gas and air using spark plugs. Gas diesel engines use a continuous injection of a small amount, such as, for example, 5–10%, of diesel fuel.

Gas engines operate at high temperatures such as greater than 200° C. in a piston environment. These high temperatures cause oxidation of the gas engine lubricating oil composition, which produces undesirable acids. These acids cause corrosion of the gas engine, in particular, corrosion of bearings in crankshaft journals and crankpins. Acids are also produced if the gas engine uses a fuel that is rich in sulfur.

It is important that a gas engine lubricating oil composition does not produce piston deposits or in the case of two-stroke engines cause plugging of exhaust slots. The gas engine lubricating oil composition should therefore preferably have either a low ash content such as, for example, below 0.6 wt % ash, or a medium ash content such as, for example, between 0.6 and 1.5 wt % ash, as determined by ASTM D874. If a lubricating oil composition has an ash level that is too low, it will shorten the working life of valves and cylinder heads. If, on the other hand, a lubricating oil composition has an ash level that is too high, excessive deposits will be produced in upper combustion chambers and upper piston areas.

Gas engine lubricating oil compositions usually include a major amount of base oil of lubricating viscosity and the following additives: up to 10 wt % of detergents, 0.5 to 8 wt % of dispersants, 0.05 to 2.0 wt % of antioxidants, 0.01 to 0.2 wt % of metal deactivators, 0.05 to 1.5 wt % of anti-wear additives, 0.05 to 0.6 wt % of pour point depressants, 0.001 to 0.2 wt % of anti-foam agents and 0.1 to 3.0 wt % of viscosity index improvers.

The present invention is concerned with the problem of providing an improved gas engine lubricating oil composition. In particular, the present invention is concerned with the problem of providing a gas engine lubricating oil composition that exhibits reduced corrosion of the gas engine. The present invention is also concerned with the problem of providing a gas engine lubricating oil composition that exhibits reduced deposits at high temperatures.

In accordance with the present invention there is provided a gas engine lubricating oil composition having a TBN in the range of 3.5 to 20, the gas engine lubricating oil composition comprising:

an oil of lubricating viscosity; and at least one metal detergent;

characterised in that the gas engine lubricating oil composition is substantially free from dispersant.

In accordance with the present invention there is also provided a method of lubricating a gas engine, the method comprising the step of operating the gas engine while lubricating it with a gas engine lubricating oil composition that is substantially free from dispersant, the gas engine lubricating oil composition comprising at least one metal detergent.

In accordance with the present invention there is also provided a gas engine lubricating oil concentrate that is substantially free from dispersant, the concentrate comprising at least one metal detergent.

By 'substantially free' we include the gas engine lubricating oil composition being totally free from dispersant and the gas engine lubricating oil composition comprising only negligible amounts of dispersant which are insufficient to provide a dispersant effect, such amounts being, for example, less than 0.5 wt % dispersant, preferably less than 0.1 wt % dispersant, or, in terms of nitrogen content, less than 0.01 wt % nitrogen, preferably less than 0.001 wt % nitrogen and most preferably around 0.000 wt % nitrogen.

The gas engine lubricating oil composition preferably includes less than 0.5 wt % dispersant, even more preferably less than 0.1 wt % dispersant. Most preferably, the gas engine lubricating oil composition is completely free from dispersant.

The inventors have surprisingly found that removing dispersant from gas engine lubricating oil compositions reduces corrosion of the gas engine (as shown, for example, using the Ball Rust test). The inventors have also found that removing dispersant from gas engine lubricating oil compositions reduces the build-up of deposits (as shown, for example, using the Panel Coker Test).

Lubricating Oil Composition

The lubricating oil composition preferably has a TBN in the range of from 4 to 20, more preferably from 6 to 20, even more preferably 6 to 15.

Oil of Lubricating Viscosity

The oil of lubricating viscosity (also referred to as lubricating oil) may be any oil suitable for the lubrication of a gas engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tridecyl adipate, or polymeric hydrocarbon lubricating oils such as, for example, liquid polyisobutene and poly-alpha olefins. Commonly, a mineral oil is employed. The lubricating oil generally comprises greater than 60, typically greater than 70, wt % of the lubricant. The lubricating oil typically has a kinematic viscosity at 100° C. of from 2 to 40, for example from 3 to 15, $mm^2s^{-1}$ and a viscosity index of from 80 to 100, for example, from 90 to 95. Another class of lubricating oils is hydrocracked oils, where the refining process further breaks down the middle and heavy distillate fractions in the presence of hydrogen at high temperatures and moderate pressures. Hydrocracked oils typically have a kinematic viscosity at 100° C. of from 2 to 40, for example from 3 to 15, $mm^2s^{-1}$ and a viscosity index typically in the range of from 100 to 110, for example from 105 to 108.

The oil may include 'brightstock' which refers to base oils that are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, wt %, based on the weight of the composition.

Metal Detergent

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

The detergent comprises a polar head with a long hydrophobic tail. The polar head comprises a metal salt of a surfactant. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The metal may be an alkali or alkaline earth metal such as, for example, sodium, potassium, lithium, calcium, barium and magnesium. Calcium is preferred.

The surfactant may be a salicylate, a sulfonate, a carboxylate, a phenate, a thiophosphate or a naphthenate. Metal salicylate is the preferred metal salt.

The detergent may be a complex/hybrid detergent prepared from a mixture of more than one metal surfactant, such as a calcium alkyl phenate and a calcium alkyl salicylate. Such a complex detergent is a hybrid material in which the surfactant groups, for example phenate and salicylate, are incorporated during the overbasing process. Examples of complex detergents are described in the art.

Surfactants for the surfactant system of the metal detergents contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility. Advantageously the alkyl groups include from 5 to 100, preferably from 9 to 30, more preferably 14 to 20, carbon atoms. Where there is more than one alkyl group, the average number of carbon atoms in all of the alkyl groups is preferably at least 9 to ensure adequate oil-solubility.

The detergents may be non-sulfurized or sulfurized, and may be chemically modified and/or contain additional substitutents. Suitable sulfurizing processes are well known to those skilled in the art.

The detergent preferably has a TBN less than 250, more preferably less than 100.

The detergents may be used in a proportion in the range of 0.5 to 30, preferably 2 to 20, or more preferably 2 to 15, wt % based on the weight of the lubricating oil composition.

Other Additives

Antiwear additives may be present in the gas engine lubricating oil composition. The antiwear additives may be metallic or non-metallic, preferably the former.

Dihydrocarbyl dithiophosphate metal salts are examples of anti-wear additives that may be used in the present invention. The metal in the dihydrocarbyl dithiophosphate metal salts may be an alkali or alkaline earth metal, or aluminium, lead, tin, molybdenum, manganese, nickel or copper. Zinc salts are preferred, preferably in the range of 0.1 to 1.5, preferably 0.5 to 1.3, wt %, based upon the total weight of the gas engine lubricating oil composition. They may be prepared in accordance with known techniques by firstly forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary and hydrocarbyl groups that are entirely primary. To make the zinc salt, any basic or neutral zinc compound may be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, 1-propyl, n-butyl, 1-butyl, sec-butyl, amyl, n-hexyl, 1-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophoshoric acid will generally be 5 or greater. The zinc dihydrocarbyl dithiophosphate can therefore comprise zinc dialkyl dithiophosphates.

Antioxidants may also be added to the gas engine lubricating oil composition. These may be aminic or phenolic. Examples of aminic include secondary aromatic amines such as diarylamines, for example diphenylamines wherein each phenyl group is alkyl-substituted with an alkyl group having 4 to 9 carbon atoms. Examples of phenolics include hindered phenols, including mono-phenols and bis-phenols. The anti-oxidant may be present in an amount of up to 3 wt %.

One or more of the following additives may also be present in the gas engine lubricating oil composition: pour point depressants such as poly(meth)acrylates or alkyl aromatic polymers; anti-foaming agents such as silicone anti-foaming agents; viscosity index improvers such as olefin copolymers; dyes; metal deactivators such as aryl thiazines, triazoles or alkyl substituted dimercapto thiadiazoles; and demulsifiers.

It may be desirable to prepare an additive package or concentrate of the gas engine lubricating oil composition. The additive package may be added simultaneously to the base oil to form the gas engine lubricating oil composition. Dissolution of the additive package into the lubricating oil may be facilitated by solvents and by mixing accompanied with mild heating. The additive package will typically be formulated to contain the detergent in proper amounts to provide the desired concentration, and/or to carry out the intended function in the final formulation when the additive package is combined with a predetermined amount of base lubricant. The additive package may contain active ingredients in an amount, based on the additive package, of, for example, from 2.5 to 90, preferably from 5 to 75, most preferably from 8 to 60, wt % of additives in the appropriate proportions, the remainder being base oil.

The final formulations may typically contain about 5 to 40 wt % of the additive package, the remainder being base oil.

The term 'active ingredient' (a.i.) as used herein refers to the additive material that is not diluent.

The present invention is illustrated by, but in no way limited to, the following examples.

EXAMPLES

Gas engine lubricating oil compositions identified in Table 1 were prepared by:

blending the detergents at room temperature for approximately 10 minutes;

adding all of the other components; and heating the mixture to 60° C. for 30 minutes while stirring.

TABLE 1

| | Example 1 | Comparative Example 1 | Comparative Example 2 | Comparative Example 3 |
|---|---|---|---|---|
| 64BN Salicylate (available from Infineum UK Ltd) | 5.20 | 5.20 | 5.20 | 5.20 |
| Dispersant C 9231 (available from Infineum UK Ltd) | | | 3.00 | |
| Dispersant C 9265 (available from Infineum UK Ltd) | | | | 3.00 |
| Dispersant C 9260 (available from Infineum UK Ltd) | | 2.00 | | |
| Nitrogen Content (% w) | 0.00 | 0.018 | 0.047 | 0.021 |
| ZDDP C 9415 (available from Infineum UK Ltd) | 0.26 | 0.26 | 0.26 | 0.26 |
| Aminic Anti-oxidant C 9452 (available from Infineum UK Ltd) | 1.35 | 1.35 | 1.35 | 1.35 |
| Antifoam C 9496 (available from Infineum UK Ltd) | | 0.10 | 0.10 | 0.10 |
| Base Oil Group I | Esso | Esso | Esso | Esso |

Tests

The gas engine lubricating oil compositions in Table 1 were subjected to the following tests:

Base Number, ASTM D 2896-98;

Ash content, ASTM D 874-00;

Ball Rust Test, ASTM D 6557-00; and

Panel Coker Test (see below).

The Panel Coker Test

This test involves splashing a gas engine lubricating oil composition on to a heated test panel to see if the oil degrades and leaves any deposits that might affect engine performance. The test uses a panel coker tester (model PK-S) supplied by Yoshida Kagaku Kikai Co, Osaka, Japan. The test starts by heating the gas engine lubricating oil composition to a temperature of 100° C. through an oil bath. A test panel made of aluminium alloy, which has been cleaned using acetone and heptane and weighed, is placed above the gas engine lubricating oil composition and heated to 320° C. using an electric heating element. When both temperatures have stabilised, a splasher splashes the gas engine lubricating oil composition on to the heated test panel in a discontinuous mode: the splasher splashes the oil for 15 seconds and then stops for 45 seconds. The discontinuous splashing takes place over 1 hour, after which the test is stopped, everything is allowed to cool down, and then the aluminium test panel is weighed and rated visually. The difference in weight of the aluminium test panel before and after the test, expressed in mg, is the weight of deposits. The visual rating is made from 0 to 10, with 0 being for a completely black panel and 10 being for a completely clean panel.

Results

The results of the tests are summarised in Table 2 below.

TABLE 2

| | Example 1 | Comparative Example 1 | Comparative Example 2 | Comparative Example 3 |
|---|---|---|---|---|
| Base Number | 5.2 | 5.2 | 5.2 | 5.2 |
| Ash Content (%) | 0.44 | 0.44 | 0.44 | 0.44 |
| Ball Rust, Merit P/F: 100 | 105 | 81 | 87 | 76 |
| Panel Coker (300° C.) Plate Rating (Merit) | 7.1 | 3.9 | 5.2 | 4.3 |
| Panel Coker (300° C.) Deposits (grams) | 8.9 | 10.9 | 10.0 | 12.9 |

As shown in the Table above, Example 1 in accordance with the invention exhibits an unexpectedly high result in the Ball Rust test, which means that it exhibits reduced corrosion. Example 1 also exhibits an unexpectedly low deposit and a high Plate Rating in the Panel Coker test at high temperature. Example 1 is therefore an improved gas engine lubricating oil composition.

What is claimed is:

1. A gas engine lubricating oil composition having a TBN in the range of 3.5 to 20, the gas engine lubricating oil composition comprising:

an oil of lubricating viscosity; and at least one metal salicylate detergent;

characterised in that the gas engine lubricating oil composition is substantially free from dispersant.

2. The composition as claimed in claim 1, wherein the gas engine lubricating oil composition comprises less than 0.5 wt % dispersant.

3. The composition as claimed in claim 2, wherein the gas engine lubricating oil composition comprises less than 0.1 wt % dispersant.

4. The composition as claimed in claim 1, wherein the gas engine lubricating oil is completely free from dispersant.

5. The composition as claimed in claim 1, wherein the gas engine lubricating oil composition has a nitrogen content of less than 0.01 wt %.

6. The composition as claimed in claim 1, wherein the gas engine lubricating oil composition has a nitrogen content of less than 0.001 wt %.

7. The composition as claimed in claim 1, further comprising an antiwear additive and an antioxidant.

8. The composition as claimed in claim 1, wherein at least one metal salicylate detergent is a complex/hybrid metal detergent prepared from a mixture of salicylate and at least one more surfactant.

9. The composition as claimed in claim 8, wherein the metal in the metal detergent is selected from calcium, barium, sodium, lithium, potassium and magnesium.

10. The composition as claimed in claim 1, wherein the metal detergent is calcium salicylate.

11. A method of lubricating a gas engine, the method comprising the step of operating the gas engine while lubricating it with the gas engine lubricating oil composition claimed in claim 1.

12. A gas engine lubricating oil having a TBN in the range of 3.5 to 20, comprising a major amount of oil of lubricating viscosity, 0.5 to about 30 wt. % of at least one metal salicylate detergent, 0.05 to 3.0 wt % of antioxidant, 0.05 to 1.5 wt. % of anti-wear additive and less than 0.5 wt. % of dispersant.

* * * * *